United States Patent [19]

Höfer et al.

[11] 4,359,994

[45] Nov. 23, 1982

[54] FUEL INJECTION PUMP FOR INTERNAL COMBUSTION ENGINES

[75] Inventors: Gerald Höfer, Weissach-Flacht; Karl Konrath, Ludwigsburg; Helmut Laufer, Stuttgart, all of Fed. Rep. of Germany

[73] Assignee: Robert Bosch GmbH, Stuttgart, Fed. Rep. of Germany

[21] Appl. No.: 146,877

[22] Filed: May 5, 1980

[30] Foreign Application Priority Data

Jun. 23, 1979 [DE] Fed. Rep. of Germany ..... 2925418

[51] Int. Cl.[3] ..... F02B 3/00

[52] U.S. Cl. ..... 123/502

[58] Field of Search ..... 123/502

[56] References Cited

U.S. PATENT DOCUMENTS

| | | | |
|---|---|---|---|
| 3,557,765 | 1/1971 | Nystrom | 123/502 |
| 4,014,305 | 3/1977 | Skinner | 123/502 |
| 4,019,835 | 4/1977 | Skinner | 123/502 |
| 4,050,433 | 9/1977 | Tokashiki | 123/502 |
| 4,052,971 | 10/1977 | Salzgeber | 123/502 |
| 4,116,186 | 9/1978 | Drori | 123/502 |
| 4,138,981 | 2/1979 | Green | 123/502 |
| 4,153,027 | 5/1979 | Drori | 123/502 |

*Primary Examiner*—Ronald B. Cox

*Attorney, Agent, or Firm*—Edwin E. Greigg

[57] ABSTRACT

The invention relates to a fuel injection pump for internal combustion engines having an injection onset adjuster with which the injection onset is adjustable toward "early", for instance in accordance with temperature. In accordance with the invention this adjustment toward "early" is made possible especially in pumps having a load-dependent injection onset adjustment, which preferably exhibit a shift toward "late" up to full load.

7 Claims, 1 Drawing Figure

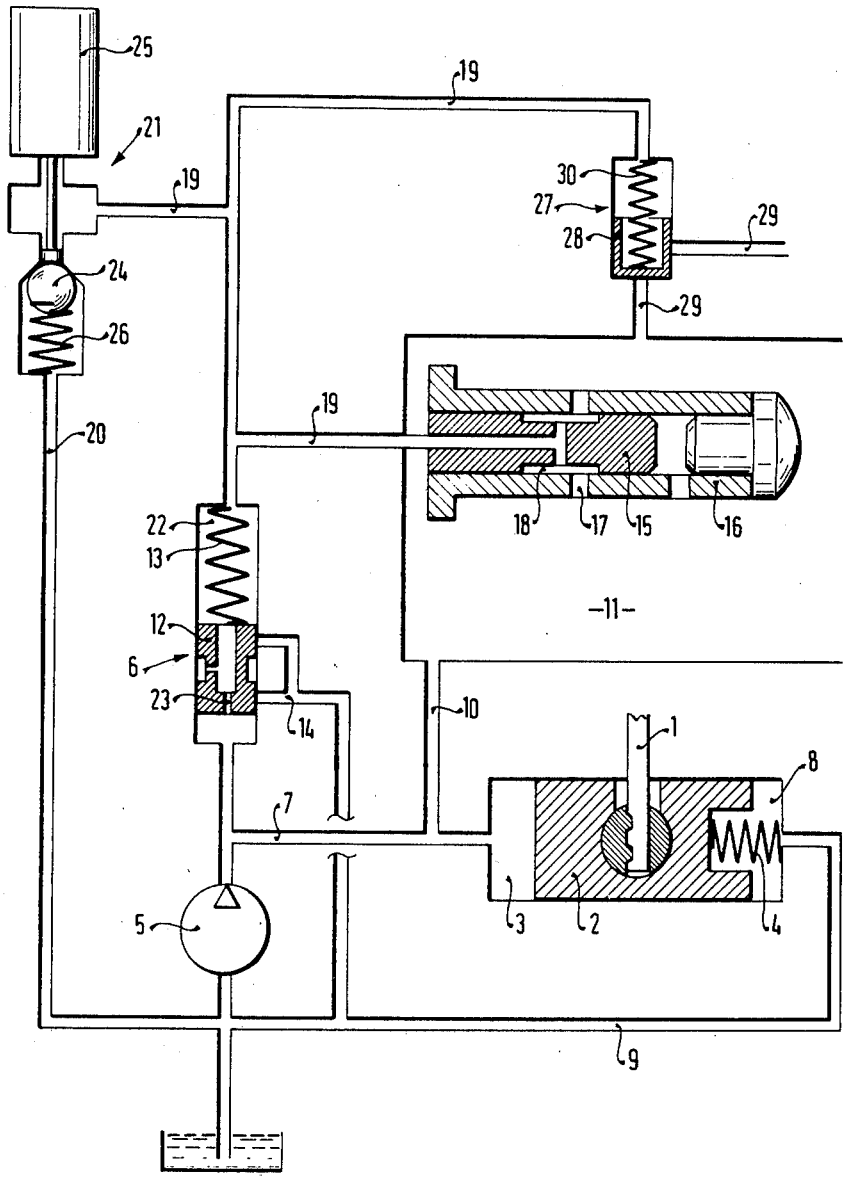
25
21
19
19
30
27
28
29
29
24
26
20
19
18
17
15
16
22
13
12
6
23
14
10
1
8
7
5
3
2
4
9
-11-

FUEL INJECTION PUMP FOR INTERNAL COMBUSTION ENGINES

BACKGROUND OF THE INVENTION

The invention relates to a fuel injection pump. In a known fuel injection pump of this kind, injection timing adjustment is effected solely in accordance with rpm. Combustion in an internal combustion engine, however, is affected very greatly as well by the load on the engine, so that the load must also be taken into consideration in optimizing the course of combustion at the onset of injection.

OBJECT AND SUMMARY OF THE INVENTION

The fuel injection pump according to the invention meets an engine requirement, namely that the necessary load influence on the instant of injection is exerted at full load, and that when an injection onset adjustment occurs in accordance with engine characteristics during starting, the load-dependent fuel overflow and the constant fuel overflow are blocked, in order to assure the reliability of this shift in injection onset toward "early."

The invention will be better understood and further objects and advantages thereof will become more apparent from the ensuing detailed description of a preferred embodiment taken in conjunction with the drawings.

BRIEF DESCRIPTION OF THE DRAWINGS

One exemplary embodiment of the invention is shown in simplified form in the drawing and explained further in the following description.

DESCRIPTION OF THE PREFERRED EMBODIMENTS

In the highly simplified representation of an injection pump given in the drawing, the pump piston and the cam drive thereof are not themselves shown, because they may be embodied in many different forms. Engaging the cam drive for the purpose of injection timing adjustment, also known, is a shaft 1 of an injection adjustment piston 2, which is displaceable by the fluid pressure in a work chamber 3 counter to the force of a restoring spring 4. In order to create this pressure, a supply pump 5 is driven with the fuel injection pump, its supply volume being proportional to the rpm. This pressure is regulated in proportion to the rpm via a pressure control valve 6, so that by way of the appropriate pressure in the work chamber 3 the injection adjustment piston 2 is displaced counter to the force of the spring 4 with increasing rpm, and accordingly with increasing pressure. The injection onset is thus increasingly shifted toward "early", in the conventional manner, with increasing rpm.

A pressure line 7 leads from the supply pump 5 to the work chamber 3; a leakage line 9 flows from the chamber 8 enclosing the spring 4 back to the suction side of the pump. From the pressure line 7, an equalizing line 10 leads to a suction chamber 11 of the injection pump, so that the same pressure prevails in the suction chamber 11 as in the work chamber 3. Pressure changes in the suction chamber 11 cause correspondent pressure changes in the work chamber 3.

The pressure control valve 6 functions with a control piston 12. Under the influence of the fuel supplied by the supply pump 5, which acts counter to the force of a spring 13, this control piston 12 opens a leakage line 14, which likewise leads to the suction side of the pump 5, to a greater or lesser extent.

From the direction of the pump housing, a tang 15 protrudes into the suction chamber 11. An adjustment member including a sleeve 16 is disposed, axially displaceable, on the tank 15 and its position is a gauge for the load. By way of example, the adjustment sleeve of a centrifugal governor can act as the adjustment member 16, with the flyweights engaging it in one direction and a restoring force in the other, the restoring force being varied either arbitrarily or in accordance with load. However, instead of making the adjustment dependent on centrifugal force, a hydraulic force can also be used; what is of the essence for the adjustment member 16 is the load-dependent engagement or position thereof. This sleeve 16 has a control bore 17, open in the direction of the suction chamber 11, which cooperates with an annular groove 18 in the tang 15 leading via a diversion channel 19 to a discharge channel 20. The discharge channel 20 is relieved of pressure and communicates, for example, with the suction side of the supply pump 5. The adjustment member 16 is shown in the full-load position in which the diversion channel is opened. As soon as the load is reduced, the adjustment member 16 is displaced to the right to such an extent that the suction chamber 11 no longer communicates with the diversion channel 19. Thus, as soon as a full engine load exists and the diversion channel 19 is opened, fuel can flow out of the suction chamber 11, which results in a pressure reduction extending as far as the work chamber 3, thus causing an adjustment in injection timing toward "late". At a lower load, the communication of the suction chamber 11 with the diversion channel 19 is then broken, and the injection instant is determined solely by the pressure control valve 6. This situation pertains so long as a discharge valve 21 is opened, that is, during normal engine operation.

During starting of a cold engine or under other preconditions which need not be specified further, an adjustment toward "early" relative to normal regulation can be attained by blocking the discharge valve 21 or at least throttling it. As a result, the discharge from the diversion channel 19 into the discharge channel 20 is backed up, so that at full load the adjustment toward "late" which is described above cannot take place, or can take place only to a limited extent, via the adjustment member 16.

The chamber 22 enclosing the spring 13 of the pressure control valve 6 communicates with the diversion channel 19, so that a backup in the diversion channel 19 also extends into the chamber 22 and there acts, reinforcing the effect of the spring 13, upon the control piston 12. The control piston 12 is displaced downward as seen in the drawing, as a result of which the pressure of the supply pump 5 in the work chamber 3 increases and the injection adjustment piston 2 is displaced toward the right, in the direction of "early." Instead of communicating with the diversion channel 19, this chamber 22 can also be controlled by means of a separate discharge valve 21 for the purpose of adjustment toward "early." What is essential is that during full load no pressure drop, which would cause an adjustment toward "late," is possible in the work chamber 3 of the injection adjustment piston 2 whenever the discharge valve or valves 21 is or are blocked.

In order to assure satisfactory functioning of the arbitrary intervention made in the adjustment of injection timing via the discharge valve 21 in the partial-load range as well, in which the diversion channel 10 is blocked by the adjustment member 16, a longitudinal throttle bore 23 can advantageously be disposed in the adjustment piston 12. So long as the discharge valve 21 is opened, fuel can always flow through this throttle bore 23, so the fuel is then suitably capable of being dammed up if desired.

The discharge valve 21 is embodied as a pressure limitation valve 24, which can be opened via a servomotor 25. A spring 26 acts in the closing direction. A mechanically actuated adjustment member, an electromagnet, an expansion element, or a servomotor itself may be used as the servomotor 25. The engine characteristic most often used for initial adjustment in this case is the temperature.

The backup pressure or dammed pressure arising in the diversion channel 19 can be utilized for the purpose of closing a conventionally used overflow valve 27 during the backup period. Thus the pressure in chambers 11 and 3, and the displacement of injection onset toward "early," can be still further increased while the engine is running up to operational speed. This overflow valve 27, with a piston 28, controls an overflow line 29 of the suction chamber 11; that is, the piston 28 is displaced to a greater or lesser extent counter to the force of a restoring spring 30. The diversion channel 19 is connected with the chamber of the overflow valve 27 which encloses the spring 30, so that a backup pressure arising in the diversion channel 19 reinforces the action of the spring 30 and displaces the piston into the illustrated position. The drawing shows the fuel injection pump at full load and with a closed discharge valve 21. The overflow valve 27 is closed as a result of the backup pressure; at the pressure control valve 6, the piston 12 is displaced so as to close off the leakage line 14, and the adjustment member 16 connects the suction chamber 11 with the diversion channel 19.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines having an rpm governor with an adjustment member actuated in accordance with load and rpm and further including a supply pump, the pressure of which is exerted upon an injecting adjustment piston having a high pressure side for the purpose of adjusting fuel injection onset, wherein said pressure is controllable on the one hand via a pressure control valve in proportion to rpm and on the other hand via a first discharge valve (17, 18) actuated in accordance with engine characteristics by permitting a discharge of partial fuel quantities, characterized in that said adjustment member at least indirectly controls a discharge opening of a diversion channel leading from said high pressure side of said adjustment piston to a low pressure side and being opened substantially at full load and further including a second discharge valve which is provided in said diversion channel downstream of said discharge opening which is controllable independent of any further engine characteristics.

2. A fuel injection pump as defined by claim 1, characterized in that said discharge valve is embodied as a pressure limitation valve, which is operable by a servomotor functioning in accordance with engine characteristics.

3. A fuel injection pump as defined by claim 1, characterized in that said pressure control valve is disposed in a chamber, said pressure control valve further including a control slide loaded by a spring and said chamber of said pressure control valve communicates with said diversion channel.

4. A fuel injection pump as defined by claim 3, characterized in that said control slide of said pressure control valve includes a longitudinal throttle bore.

5. A fuel injection pump as defined in claim 3, characterized in that said control slide opens a first discharge opening and, after covering an appropriate stroke distance, opens a second discharge opening.

6. A fuel injection pump as defined by claims 2, 3, 4, 5 or 7 characterized in that said diversion channel is in communication with an overflow valve, said overflow valve arranged to be connected at predetermined intervals with said diversion channel.

7. A fuel injection pump as defined by claim 4, characterized in that said control slide opens a first discharge opening and, after covering an appropriate stroke distance, opens a second discharge opening.

* * * * *